US008640640B2

(12) United States Patent
Conti et al.

(10) Patent No.: US 8,640,640 B2
(45) Date of Patent: Feb. 4, 2014

(54) INFLATABLE HULL CONFIGURATION AND CONNECTION FOR A MULTIHULL VESSEL

(75) Inventors: Ugo Conti, El Cerrito, CA (US); Mark Gundersen, San Pablo, CA (US)

(73) Assignee: Marine Advanced Research, Inc., Richmond, CA (US)

( * ) Notice: Subject to any disclaimer, the term of this patent is extended or adjusted under 35 U.S.C. 154(b) by 363 days.

(21) Appl. No.: 12/688,634

(22) Filed: Jan. 15, 2010

(65) Prior Publication Data

US 2010/0288174 A1 Nov. 18, 2010

Related U.S. Application Data

(60) Provisional application No. 61/177,865, filed on May 13, 2009.

(51) Int. Cl.
*B63B 1/14* (2006.01)
*B63B 7/08* (2006.01)

(52) U.S. Cl.
USPC ..... 114/61.15; 114/61.17; 114/61.19; 114/61.25

(58) Field of Classification Search
USPC ..... 114/56.1, 61.25, 283, 61.15–61.19
See application file for complete search history.

(56) References Cited

U.S. PATENT DOCUMENTS 2,119,775 A * 6/1938 Chase ..... 114/61.15
2,347,959 A * 5/1944 Moore et al. ..... 114/283
3,981,259 A * 9/1976 Harper, Jr. ..... 114/61.15
4,366,769 A * 1/1983 Lingeman ..... 114/352
4,386,441 A 6/1983 Lundholm (Continued)

FOREIGN PATENT DOCUMENTS

| | | |
|---|---|---|
| DE | 2432744 | 1/1976 |
| WO | WO-03/072426 | 9/2003 |
| WO | WO-2006/068725 | 6/2006 |

OTHER PUBLICATIONS

"International Search Report and Written Opinion of the International Searching Authority Dated Jul. 9, 2010", *International Application No. PCT/US2010/034441.*

(Continued)

*Primary Examiner* — Stephen Avila
*Assistant Examiner* — Andrew Polay
(74) *Attorney, Agent, or Firm* — Blakely Sokoloff Taylor & Zafman LLP

(57) ABSTRACT

Inflatable hull configuration and connection for a multihull vessel. The inflatable hulls have a longitudinal structural member fastened to the top of the inflatable hulls, with a central body of the multihull vessel supported on the longitudinal structural members by forward and stern legs. The forward legs support the forward part of the central body through a ball joint that allows the forward legs to rotate as a unit relative to the central body, and have their lower ends attached to the forward part of the longitudinal members, each through a spring supported ball joint. The stern legs are each rigidly coupled to the central body, with their lower ends connected to the aft part of the longitudinal members to allow rotation about a vertical axis and a transverse axis, but not the longitudinal axis. A detailed embodiment is disclosed.

25 Claims, 5 Drawing Sheets

(56) References Cited

U.S. PATENT DOCUMENTS

| | | | | |
|---|---|---|---|---|
| 5,134,950 | A * | 8/1992 | Berte | 114/39.27 |
| 5,228,404 | A * | 7/1993 | Gibbs | 114/61.16 |
| 5,540,604 | A | 7/1996 | Dayton | |
| 6,874,439 | B2 | 4/2005 | Conti | |
| 7,234,405 | B2 * | 6/2007 | Hodgson | 114/61.15 |
| 7,562,633 | B2 * | 7/2009 | Conti | 114/61.1 |
| 2003/0164131 | A1 | 9/2003 | Conti | |
| 2006/0249066 | A1 * | 11/2006 | Conti | 114/61.1 |
| 2008/0047476 | A1 | 2/2008 | Stevenson | |
| 2009/0178602 | A1 | 7/2009 | Gundersen | |

OTHER PUBLICATIONS

"Notice of Allowance Dated Apr. 22, 2013; European Patent Application No. 10775432.7", (Apr. 22, 2013).

"Office Action Dated Sep. 27, 2012; New Zealand Patent Application No. 596446", (Sep. 27, 2012).

"Supplementary European Search Report Dated Sep. 14, 2012; European Patent Application No. 10775432.7", (Sep. 14, 2012).

"Notice of Acceptance Dated Dec. 19, 2013; New Zealand Patent Application No. 596446", (Dec. 19, 2013).

* cited by examiner

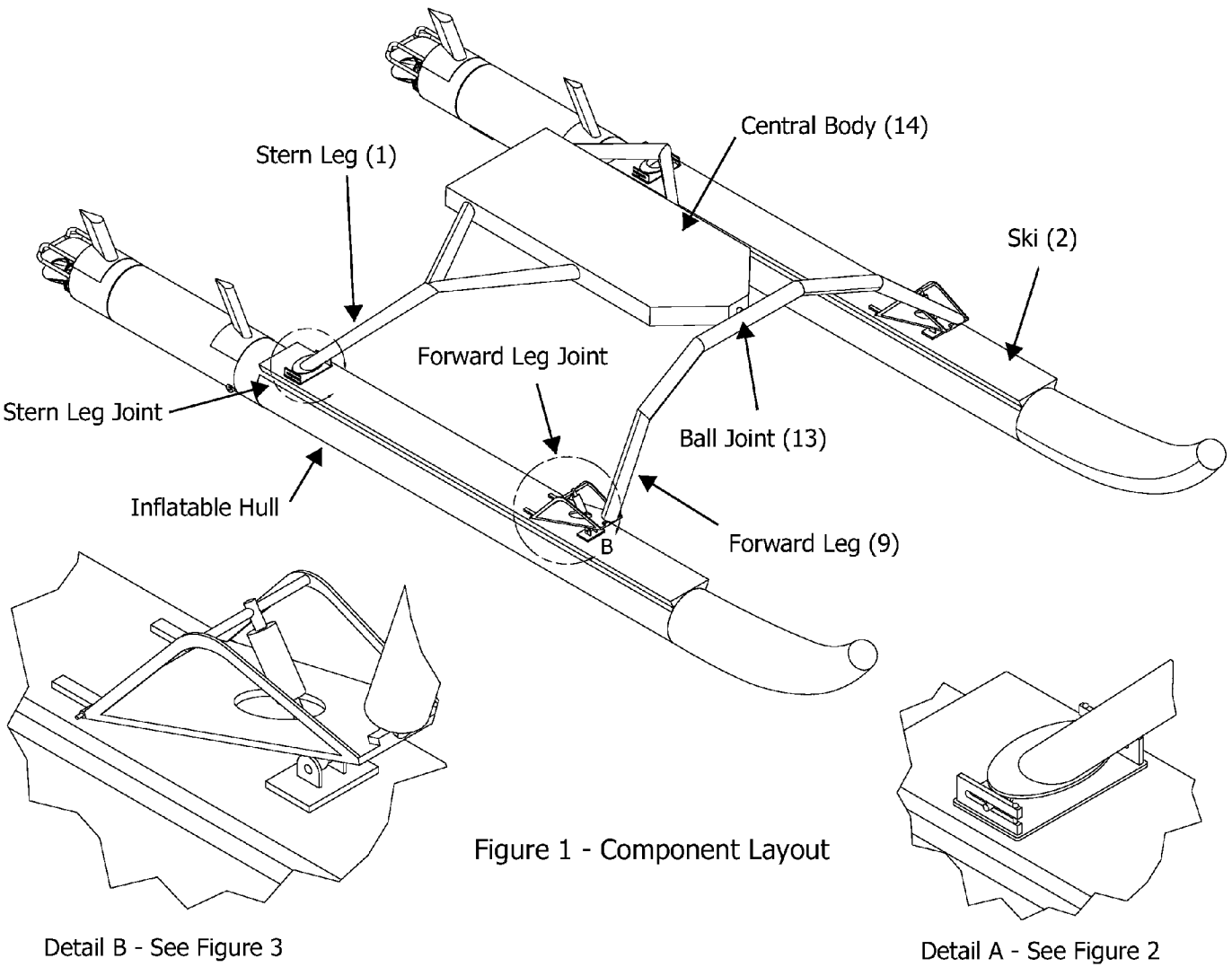
Figure 1 - Component Layout

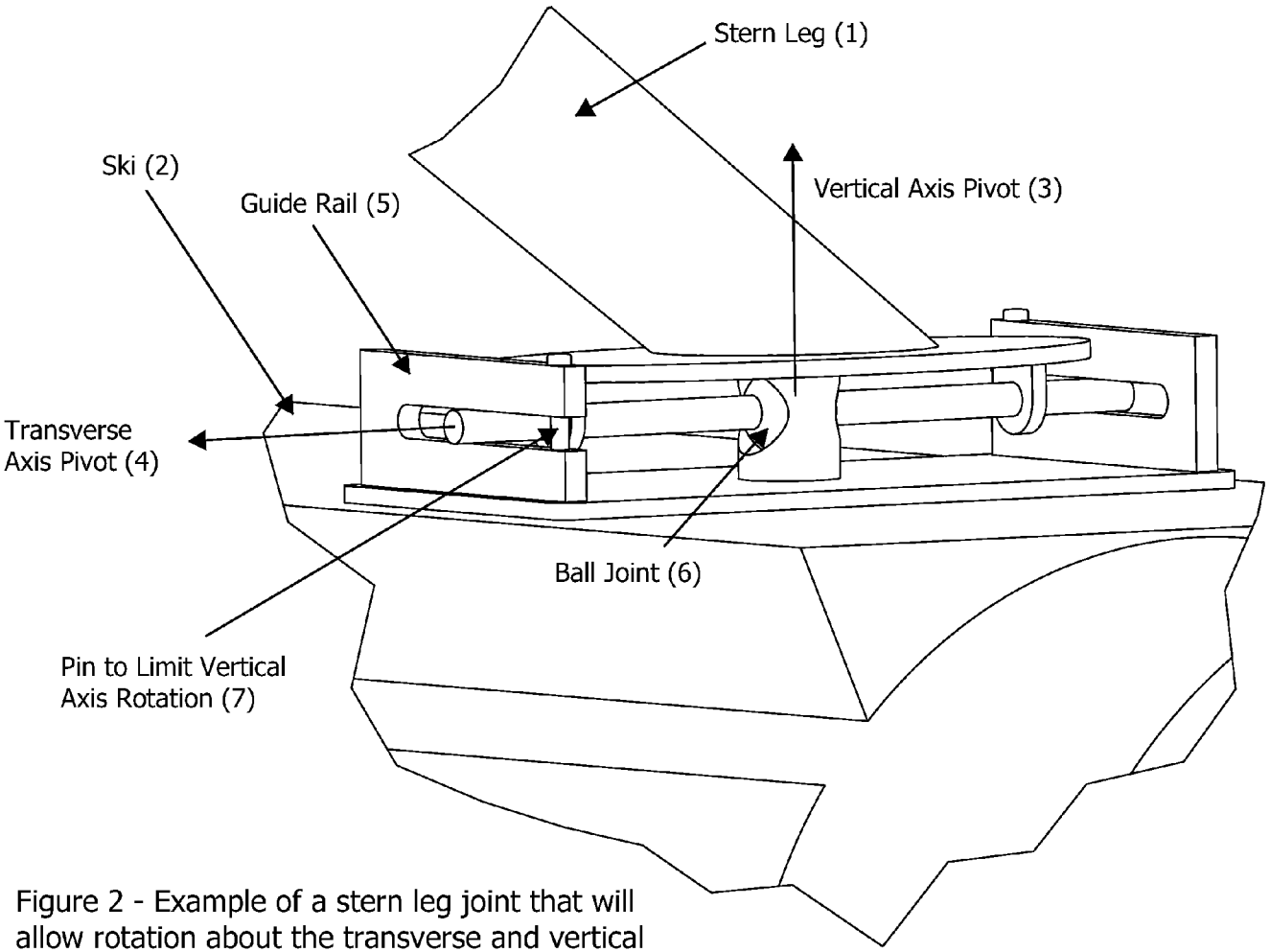
Figure 2 - Example of a stern leg joint that will allow rotation about the transverse and vertical axes but not about the longitudinal axis.

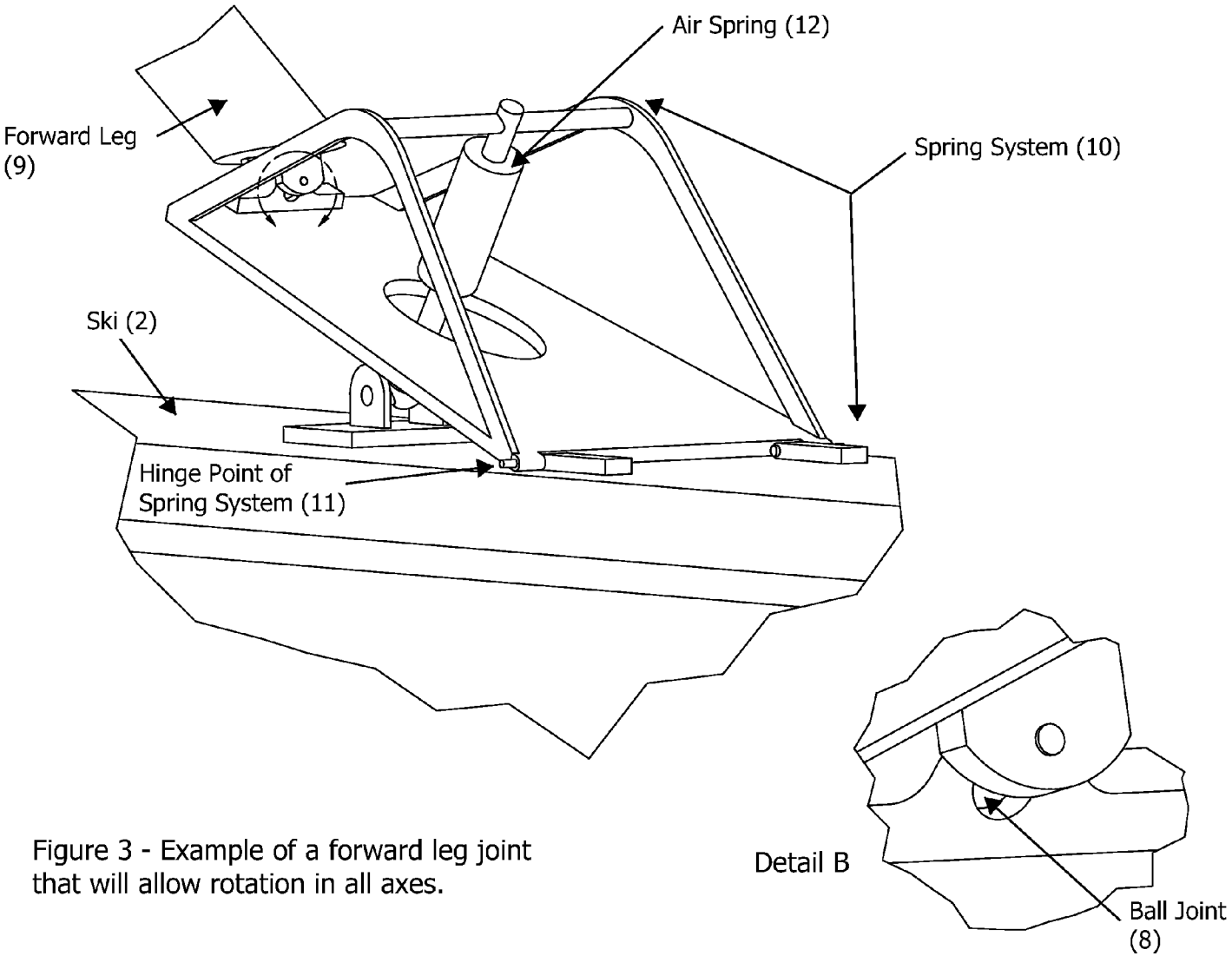
Figure 3 - Example of a forward leg joint that will allow rotation in all axes.

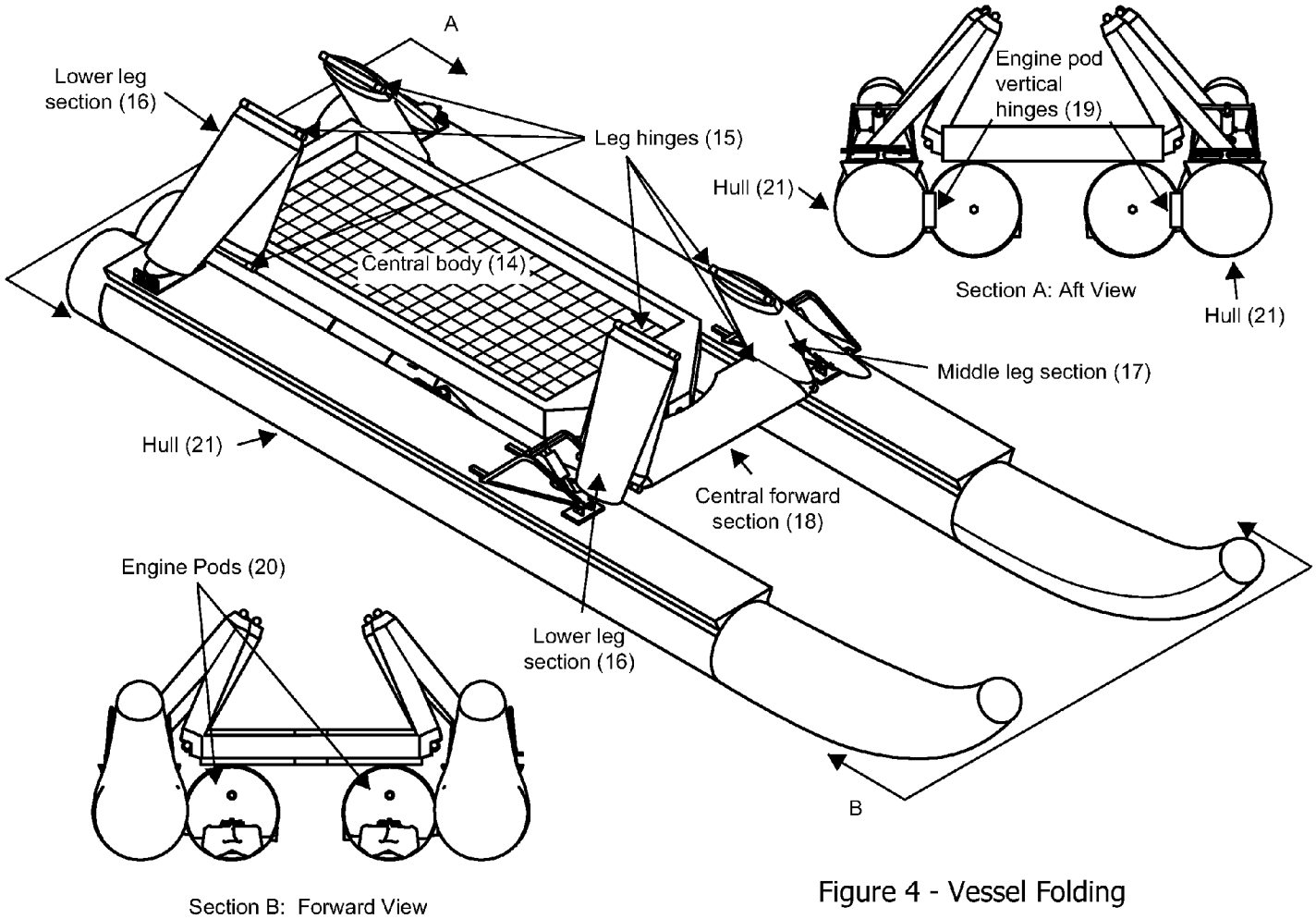
Figure 4 - Vessel Folding

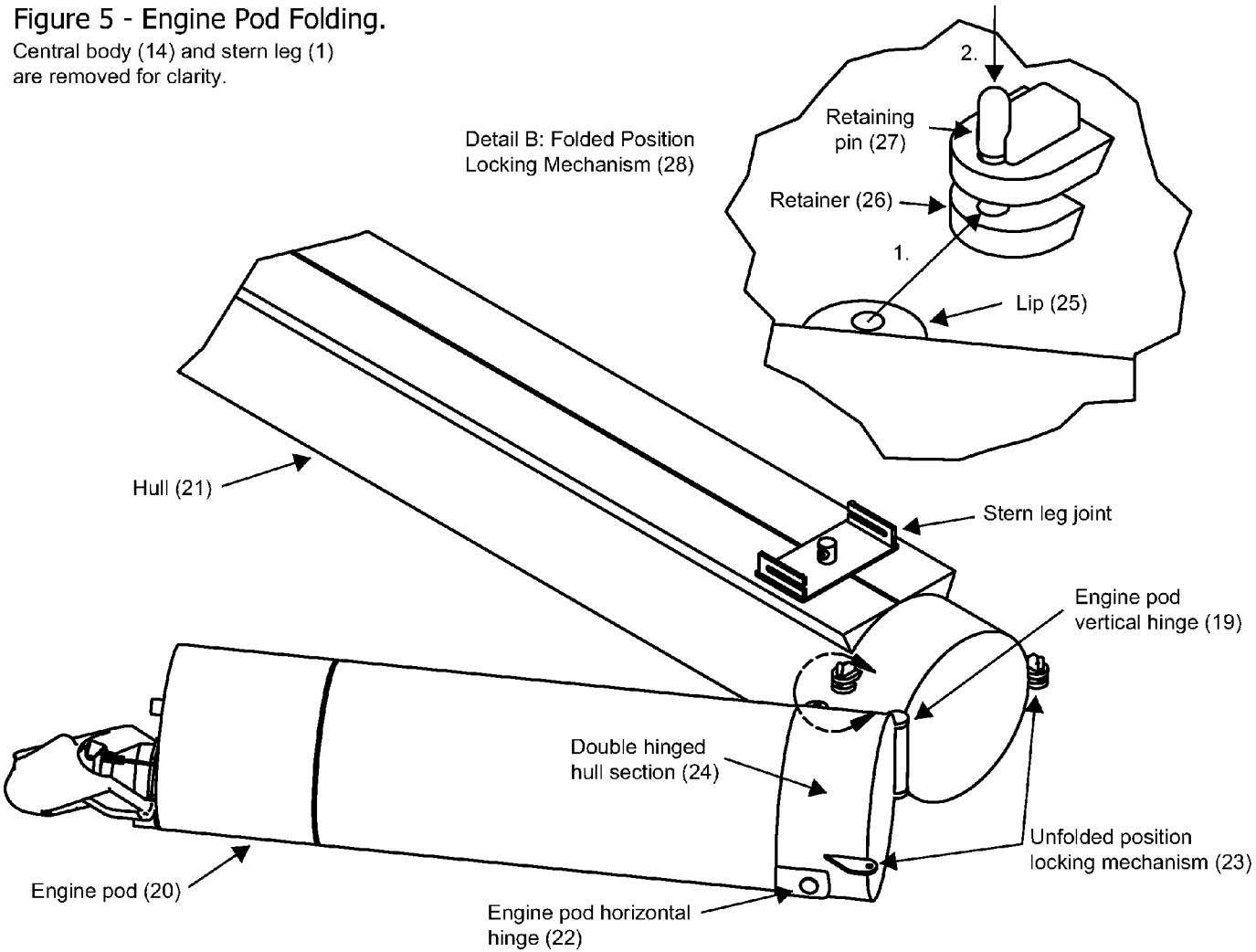
Figure 5 - Engine Pod Folding.
Central body (14) and stern leg (1) are removed for clarity.

INFLATABLE HULL CONFIGURATION AND CONNECTION FOR A MULTIHULL VESSEL

CROSS-REFERENCE TO RELATED APPLICATION

This application claims the benefit of U.S. Provisional Patent Application No. 61/177,865 filed May 13, 2009.

BACKGROUND OF THE INVENTION

1. Field of the Invention

The present invention relates to the field of watercraft, and in particular, inflatable craft.

2. Prior Art

U.S. Pat. Nos. 6,874,439 and 7,562,633 describe technologies for boats with inflatable hulls connected by a jointed structure so that such hulls adapt to the surface of the sea.

BRIEF DESCRIPTION OF THE DRAWINGS

FIG. 1 illustrates the component layout of one embodiment of the present invention.

FIG. 2 illustrates details of a stern leg joint in accordance with one embodiment of the present invention.

FIG. 3 illustrates details of a forward leg joint in accordance with one embodiment of the present invention.

FIG. 4 illustrates one embodiment of leg and hull folding in accordance with one embodiment of the present invention.

FIG. 5 illustrates further details of the embodiment of leg and hull folding of FIG. 4.

DETAILED DESCRIPTION OF THE PREFERRED EMBODIMENTS

This invention provides elements of improvement over the previous designs for wave adaptive modular vessels (WAM-V®) of the type described in the foregoing issued patents. One improvement is the addition on top of the inflatable hulls of a longitudinal structural member on each hull that can be rigid or semi-rigid according to the type of boat and its intended use. The degree of rigidity becomes a design parameter that is available to the engineer to be chosen according to boat size, payload weight, speed, expected sea states, etc.

This longitudinal member (the ski) of each hull could be considered the equivalent of the rim in an automotive wheel: it connects with the inflated part of the hulls—that is now an independent structure—just as a tire is independent and removable from the rim of a wheel (see ski (2) in FIG. 1).

The advantages of this method of hull construction are:

1. The rigidity of the ski can be defined at the design stage.
2. The ski (2) connects through the spring system (10) (FIG. 3) with the rest of the boat structure in a fixed manner that does not depend on the pressure of the inflatable hull.
3. The pressure of the inflated part of the hulls can now be set within a broader range than before. This allows the pressure to be controlled to accommodate for sea state and maximum efficiency of motion through the water. For example, in a choppy sea with short waves, a low inflation pressure allows the inflated hulls to absorb the wave impact before it reaches the payload and the rest of the boat structure.

Another improvement to the design of a WAM-V® is an improved method of connecting the two hulls with the rest of the structure in such a way that allows the hulls to move semi-independently while following the water surface.

FIG. 1 illustrates such a structure connecting two hulls, each having a ski (2) on top of the inflated hull. The structure is comprised of forward legs (9) and stern legs (1) connected by a central body (14). The two forward legs form the forward arch that is connected with the central body (14) by a ball joint (13) so as to be able to rotate as a unit with respect to the central body. In general, the ball joints described herein allow at least limited rotation about at least two axes, and usually about all three axes thereof. The ball joints described with respect to the preferred embodiment actually incorporate balls, though the phrase ball joint is used herein and in the claims in a more general sense to describe or suggest the characteristics of the joint, and not to limit the actual structure thereof. The stern legs are preferably rigidly connected to the central body (14), though may be somewhat flexible as desired.

The ends (feet) of the four legs are connected with joints and springs to the hulls skis. The stern leg joints (A, also see FIG. 2) are composed of a transversal pivot (4) and a vertical pivot (3), the vertical pivot (3) being facilitated by the slots in guide rails (5). The housing of the ball joint (6) is fastened at its bottom to the plate on which it rests and thus indirectly to the ski (2). There is some clearance between the top of the housing of the ball joint (6) and the plate on which the stern leg (1) is fastened, so that the plate and the stern leg may rotate about the transverse axis pivot (4), and the stern leg and plate may rotate about the vertical axis pivot (3). The plate is captured between the guide rails, and thus prevents linear motion along the transverse axis.

Thus the transversal pivot (4) allows the stern leg (1) to rotate about the vertical axis, but holds the hull transversally. The ball joint (6) allows motion in the vertical and transverse axis but is prevented from rotating about the longitudinal axis of the hull by the guide rails (5). The guide rails (5) also limit the rotation around the vertical axis (3), by means of pins (7), to allow for a small angle of movement necessary to avoid unwanted torsional stresses transmitted to the structure when the hulls move independently from each other.

The forward legs (9) connection to the skis (2) (FIG. 3) are ball joints (8) that allow rotation in all axis. This eliminates torsional stresses and implements the maximum number of degrees of motion freedom. The ball joint (8) connects the forward leg (9) to a spring system (10) that in FIG. 3 is implemented, as an example, with an air spring (12). The spring system is connected to the ski (2) by a hinge (11).

The forward legs joint systems (detail B) do not prevent the hull systems from twisting around the transversal axis. This rotation is prevented solely by the stern legs joint systems (A).

The modifications to the joints as described above increase the degrees of freedom for the WAM-V® technology described in U.S. Pat. No. 6,874,439, thereby minimizing stresses due to relative hull motions. Each and all improvements described above will result in increased shock mitigation and provide a smoother ride.

Another aspect of the present invention may be seen in FIGS. 4 and 5. In these Figures, the leg connections to the skis may be the same as for the embodiment of FIG. 1. The WAM-V® watercraft is a very versatile watercraft, and when configured as shown in FIGS. 4 and 5, has still additional advantages. In particular, the basic watercraft is very stable, high speed, shallow draft, and depending on the power plants used, may be beachable. As such, it has many applications wherein transportability by aircraft or over roads is highly desirable. For this purpose the central body (14) shown schematically in these Figures may be lowered by use of leg hinges (15) between the lower leg section (16) and the middle leg sections (17) so that the central forward section (18), connected to the central body (14) by a ball joint as in FIG. 1, is approximately even with the top of the skis. At the same time, the hulls (21) may be moved closer together to reduce the width of the watercraft for transportation. Prior to doing so, however, in accordance with this aspect of the invention, the engine pods (20) are rotated about vertical hinges (19) 180 degrees so as to lie adjacent the hulls (21) between the hulls as shown in section A of FIG. 4. This substantially shortens the overall length of the watercraft for transport purposes, yet has substantially no effect on the ability to move the hulls (21) closer together for watercraft width reduction.

Further details of the hinging of the engine pods (20) may be seen in FIG. 5. Engine pod vertical hinge (19) allows the engine pod (20) to be rotated as shown and locked in the rotated position by the lip and retainer assembly shown on an expanded scale in detail B of FIG. 5. In particular, the lip (25) fits between retaining members (26) on a rigid portion of the hull with a pin (27) passing through the holes in retainer (26) and lip (25) to lock the engine pod (20) in position. A similar unfolded position locking mechanism (23) is used to lock the engine pods (20) in the unfolded position for normal use of the watercraft.

Particularly as shown in FIG. 5, the engine pod vertical hinge (19) is preferably positioned somewhat forward of the double hinged hull section (24). That is the hull section which also includes the horizontal hinge characteristic of the WAM-V® type watercraft. Further details of the horizontal hinge mechanism and its function may be found in U.S. Pat. Nos. 6,874,439 and 7,562,633 and U.S. Patent Application Publication No. US-2009-0178602-A1, the disclosures of which are hereby incorporated by reference. Alternatively, of course, the vertical hinge (19) could be aft of the horizontal hinge of the WAM-V® type watercraft, though this is not preferred.

Thus the present invention has a number of aspects, which aspects may be practiced alone or in various combinations or sub-combinations, as desired. While a preferred embodiment of the present invention has been disclosed and described herein for purposes of illustration and not for purposes of limitation, it will be understood by those skilled in the art that various changes in form and detail may be made therein without departing from the spirit and scope of the invention as defined by the full breadth of the following claims.

What is claimed is:

1. In a watercraft having first and second spaced apart and parallel inflatable hulls supporting a central body on legs there between and above the inflatable hulls, the improvement comprising:

each inflatable hull having a longitudinal structural member extending over the top of the inflatable hull and fastened thereto;

the body being supported with respect to each inflatable hull by a stern leg and a forward leg;

the forward legs being coupled to the central body to allow at least a limited rotation of the forward legs as a unit with respect the central body;

a lower end of each forward leg being coupled to a forward part of a respective longitudinal structural member through a spring mounted ball joint;

an upper end of each stern leg being rigidly coupled to the central body;

a lower end of each stern leg being coupled to a rear part of a respective longitudinal structural member through a joint that allows at least limited rotation about a vertical axis and about a horizontal axis perpendicular to a length of a respective longitudinal structural member, but not about an axis parallel to the length of the respective longitudinal structural member;

wherein the stern legs are each coupled to a rear part of a respective longitudinal structural member through a ball joint assembly that allows at least limited rotation about a vertical axis and about a horizontal axis perpendicular to the length of a respective longitudinal structural member, the ball joint assembly including apparatus preventing rotation about an axis parallel to the length of the respective longitudinal structural member.

2. The watercraft of claim 1 wherein the forward legs are coupled together and to the central body through a ball joint.

3. The watercraft of claim 1 wherein the inflatable hulls each have an engine pod coupled to an aft end thereof by a horizontal hinge having a horizontal hinge axis perpendicular to a length of a respective longitudinal structural member.

4. The watercraft of claim 3 wherein the engine pods are also coupled to an aft end of the inflatable hulls by a vertical hinge allowing the engine pods to rotate about the vertical hinge axes 180 degrees so as to lie adjacent and between the inflatable hulls.

5. The watercraft of claim 4 wherein the vertical hinge is forward of the horizontal hinge.

6. The watercraft of claim 4 wherein the vertical hinge is aft of the horizontal hinge.

7. The watercraft of claim 4 further including a lock to lock the engine pods in the unrotated position, each with respect to its respective inflatable hull.

8. The watercraft of claim 4 wherein each forward leg and each stern leg is hinged to be foldable to allow the central body to lower with respect to the inflatable hulls and the inflatable hulls to move closer together.

9. In a watercraft having first and second spaced apart and parallel inflatable hulls supporting a central body on legs there between and above the inflatable hulls, the improvement comprising:

each inflatable hull having a longitudinal structural member extending over the top of the inflatable hull and fastened thereto, and having an engine pod coupled to an aft end thereof by a horizontal hinge having a horizontal hinge axis perpendicular to a length of a respective longitudinal structural member;

the body being supported with respect to each inflatable hull by a stern leg and a forward leg;

the forward legs being coupled together and to the central body through a ball joint to allow at least a limited rotation of the forward legs as a unit with respect the central body;

a lower end of each forward leg being coupled to a forward part of a respective longitudinal structural member through a spring mounted ball joint;

an upper end of each stern leg being rigidly coupled to the central body;

a lower end of each stern leg being coupled to a rear part of a respective longitudinal structural member through a joint that allows at least limited rotation about a vertical axis and about a horizontal axis perpendicular to a length of a respective longitudinal structural member, but not about an axis parallel to the length of the respective longitudinal structural member;

wherein the stern legs are each coupled to a rear part of a respective longitudinal structural member through a ball joint assembly that allows at least limited rotation about a vertical axis and about a horizontal axis perpendicular to the length of a respective longitudinal structural member, the ball joint assembly including apparatus preventing rotation about an axis parallel to the length of the respective longitudinal structural member.

10. The watercraft of claim 9 wherein the engine pods are also coupled to an aft end of the inflatable hulls by a vertical hinge allowing the engine pods to rotate about the vertical hinge axes 180 degrees so as to lie adjacent and between the inflatable hulls.

11. The watercraft of claim 10 wherein the vertical hinge is forward of the horizontal hinge.

12. The watercraft of claim 10 wherein the vertical hinge is aft of the horizontal hinge.

13. The watercraft of claim 10 further including a lock to lock the engine pods in the unrotated position, each with respect to its respective inflatable hull.

14. The watercraft of claim 10 wherein each forward leg and each stern leg is hinged to be foldable to allow the central body to lower with respect to the inflatable hulls and the inflatable hulls to move closer together.

15. In a watercraft having first and second spaced apart and parallel inflatable hulls supporting a central body on legs there between and above the inflatable hulls, the improvement comprising:

each inflatable hull having a longitudinal structural member extending over the top of the inflatable hull and fastened thereto;

the body being supported with respect to each inflatable hull by a stern leg and a forward leg;

the forward legs being coupled to the central body to allow at least a limited rotation of the forward legs as a unit with respect the central body;

a lower end of each forward leg being coupled to a forward part of a respective longitudinal structural member through a spring mounted ball joint;

an upper end of each stern leg being rigidly coupled to the central body;

a lower end of each stern leg being coupled to a rear part of a respective longitudinal structural member through a joint that allows at least limited rotation about a vertical axis and about a horizontal axis perpendicular to a length of a respective longitudinal structural member, but not about an axis parallel to the length of the respective longitudinal structural member, wherein the inflatable hulls each have an engine pod coupled to an aft end thereof by a horizontal hinge having a horizontal hinge axis perpendicular to a length of a respective longitudinal structural member and a vertical hinge allowing the engine pods to rotate about the vertical hinge axes 180 degrees so as to lie adjacent and between the inflatable hulls;

wherein the stern legs are each coupled to a rear part of a respective longitudinal structural member through a ball joint assembly that allows at least limited rotation about a vertical axis and about a horizontal axis perpendicular to the length of a respective longitudinal structural member, the ball joint assembly including apparatus preventing rotation about an axis parallel to the length of the respective longitudinal structural member.

16. The watercraft of claim 15 wherein the forward legs are coupled together and to the central body through a ball joint.

17. The watercraft of claim 15 wherein the vertical hinge is forward of the horizontal hinge.

18. The watercraft of claim 15 wherein the vertical hinge is aft of the horizontal hinge.

19. The watercraft of claim 15 further including a lock to lock the engine pods in the unrotated position, each with respect to its respective inflatable hull.

20. The watercraft of claim 15 wherein each forward leg and each stern leg is hinged to be foldable to allow the central body to lower with respect to the inflatable hulls and the inflatable hulls to move closer together.

21. In a watercraft having first and second spaced apart and parallel inflatable hulls supporting a central body on legs there between and above the inflatable hulls, the improvement comprising:

each inflatable hull having a longitudinal structural member extending over the top of the inflatable hull and fastened thereto, and having an engine pod coupled to an aft end thereof by a horizontal hinge having a horizontal hinge axis perpendicular to a length of a respective longitudinal structural member and a vertical hinge allowing the engine pods to rotate about the vertical hinge axes 180 degrees so as to lie adjacent and between the inflatable hulls;

the body being supported with respect to each inflatable hull by a stern leg and a forward leg;

the forward legs being coupled together and to the central body through a ball joint to allow at least a limited rotation of the forward legs as a unit with respect the central body;

a lower end of each forward leg being coupled to a forward part of a respective longitudinal structural member through a spring mounted ball joint;

an upper end of each stern leg being rigidly coupled to the central body;

a lower end of each stern leg being coupled to a rear part of a respective longitudinal structural member through a joint that allows at least limited rotation about a vertical axis and about a horizontal axis perpendicular to a length of a respective longitudinal structural member, but not about an axis parallel to the length of the respective longitudinal structural member wherein the stern legs are each coupled to a rear part of a respective longitudinal structural member through a ball joint assembly that allows at least limited rotation about a vertical axis and about a horizontal axis perpendicular to the length of a respective longitudinal structural member, the ball joint assembly including apparatus preventing rotation about an axis parallel to the length of the respective longitudinal structural member.

22. The watercraft of claim 21 wherein the engine pods are also coupled to an aft end of the inflatable hulls by a vertical hinge allowing the engine pods to rotate about the vertical hinge axes 180 degrees so as to lie adjacent and between the inflatable hulls, and wherein the vertical hinge is forward of the horizontal hinge.

23. The watercraft of claim 21 wherein the engine pods are also coupled to an aft end of the inflatable hulls by a vertical hinge allowing the engine pods to rotate about the vertical hinge axes 180 degrees so as to lie adjacent and between the inflatable hulls, and wherein the vertical hinge is aft of the horizontal hinge.

24. The watercraft of claim 21 further including a lock to lock the engine pods in the unrotated position, each with respect to its respective inflatable hull.

25. The watercraft of claim 21 wherein each forward leg and each stern leg is hinged to be foldable to allow the central body to lower with respect to the inflatable hulls and the inflatable hulls to move closer together.

* * * * *